US007231799B2

(12) United States Patent
Schwager et al.

(10) Patent No.: US 7,231,799 B2
(45) Date of Patent: Jun. 19, 2007

(54) METHOD AND DEVICE FOR THE PRODUCTION OF A WORKPIECE WITH INTERNAL TOOTHING, IN PARTICULAR A HOLLOW WHEEL

(75) Inventors: Aribert Schwager, Asperg (DE); Fritz Bley, Markersbach (DE); Manfred Kammerer, Asperg (DE); Klaus Siegert, Sindelfingen (DE)

(73) Assignee: Forschungsgesellschaft Umformtechnik mbH, Stuttgart (DE)

( * ) Notice: Subject to any disclaimer, the term of this patent is extended or adjusted under 35 U.S.C. 154(b) by 319 days.

(21) Appl. No.: 10/415,637

(22) PCT Filed: Nov. 1, 2001

(86) PCT No.: PCT/DE01/04192

§ 371 (c)(1),
(2), (4) Date: Apr. 30, 2003

(87) PCT Pub. No.: WO02/36287

PCT Pub. Date: May 10, 2002

(65) Prior Publication Data

US 2004/0016281 A1 Jan. 29, 2004

(30) Foreign Application Priority Data

Nov. 2, 2000 (DE) ..... 100 54 399

(51) Int. Cl.
*B21J 13/02* (2006.01)

(52) U.S. Cl. ..... 72/344; 72/354.8; 72/355.2

(58) Field of Classification Search ..... 72/343, 72/352, 353.2, 354.4, 354.6, 355.2, 355.6
See application file for complete search history.

(56) References Cited

U.S. PATENT DOCUMENTS 3,694,127 A * 9/1972 Takahashi et al. ..... 425/352
3,899,912 A * 8/1975 Orain ..... 72/344
5,823,104 A * 10/1998 Beisel et al. ..... 100/48

FOREIGN PATENT DOCUMENTS

GB 1373547 * 11/1974
JP 1-317653 * 12/1989 ..... 72/354.8
JP 6-31374 * 2/1994 ..... 72/355.4

* cited by examiner

*Primary Examiner*—Derris H. Banks
*Assistant Examiner*—Debra M Wolfe
(74) *Attorney, Agent, or Firm*—Crowell & Moring LLP

(57) ABSTRACT

The invention relates to a method and an apparatus for producing a workpiece with internal toothing, especially an internal geared wheel, by using a cup shaped preform (N) with a substantially cylindrical side wall (N1) and a mandrel (5) with an external profile (6) according to the internal toothing to be produced, as well as with a forming tool which reduces the outside diameter of the cylindrical side wall during an advancing movement, as a result of which the material of the cylinder wall region flows into the external profile (6) of the mandrel (5). In accordance with the invention, the forming tool is configured as a drawing ring (14) ensuring the ironing of the cylinder wall region (N1) during an advancing movement and that two tool elements act upon the preform (N) during the ironing, which tool elements produce axial compressive stresses in the cylinder wall region (N1) of the preform.

20 Claims, 5 Drawing Sheets

METHOD AND DEVICE FOR THE PRODUCTION OF A WORKPIECE WITH INTERNAL TOOTHING, IN PARTICULAR A HOLLOW WHEEL

BACKGROUND OF THE INVENTION

The invention relates to a method and an apparatus for producing a workpiece with internal toothing, especially an internal geared wheel, according to an apparatus for producing a workpiece with internal toothing, especially an internal geared wheel. Such internal toothings are produced by means of flow turning. A cup-like preform is pressed according to DE 198 30 817 A1 by means of tapered rollers during an advancing movement against a clamping chuck which has the external profile of the internal toothing to be produced. Said preform is reduced in its diameter, with the preform rotating relative to the tapered rollers. The material of the cylinder wall region of the preform flows into the profile of the clamping chuck, as a result of which the inner profile of the workpiece is produced. The disadvantageous aspect is the high amount of flexing work which stresses the workpiece material during the flow turning and the thus inadequate quality of the produced internal toothing. A high local introduction of energy is connected with the flexing work which leads to energy losses. The external toothing as pictured therein frequently breaks off as a result of the high stresses on the clamping chuck. Moreover, the productivity of this method is relatively low despite a high need for machinery because only three to four parts per minute can be produced.

BRIEF SUMMARY OF THE INVENTION

It is the object of the present invention to provide a method and an apparatus for an energy-saving production of a workpiece with internal toothing, especially an internal geared wheel, which ensures a substantial increase in the productivity at high quality of the internal toothing with a relatively simple constructional configuration of the apparatus.

This object is achieved by the features of an apparatus for producing a workpiece with internal toothing, especially an internal geared wheel for a gearing, comprises a mandrel with an outside profile according to the internal toothing to be produced as well as a forming tool which reduces during an advancing movement the outside diameter of a cup-like preform, as a result of which material of the cylinder wall region flows into the outside profile of the mandrel. In accordance with the invention, a drawing ring is used as the forming tool which ensures ironing of the cylinder wall region during an advancing movement.

In the direction towards the lower side of the floor of the preform an axially movable counterholder is arranged in such a way that during the ironing it acts with a counterholding force on the lower side of the floor of the preform. The counterholder may comprise a circular pressure surface facing in the direction towards the lower side of the floor, which pressure surface substantially acts upon the entire floor region, or said counterholder may comprise a ring-like pressure surface which is adjusted to the width of the cylinder wall of the preform and is aligned essentially flush with the same and acts upon the edge region of the lower side of the floor of the preform.

An axially movable pressure punch is arranged in the direction towards the face surface of the cylindrical side wall in such a way that during the ironing it acts upon the face surface with a pressure force. The pressure punch can be moved during the ironing by a movement corresponding to the ironing length of the preform in the direction of the advancing movement of the drawing ring.

Advantageously, the axial stroke movement of the pressure punch as occurs during the ironing can be controlled depending on its pressure force. For this purpose the pressure punch is held in an axially movable fashion by means of a hydraulic piston.

The apparatus can advantageously be integrated in a hydraulic press consisting of a bedplate and a press ram. The mandrel is arranged in an axially fixed fashion on the bedplate and the press stamp is held on the mandrel in a manner so as to be axially displaceable by means of a hydraulic piston. The drawing ring is arranged on the press stamp in a preferably fixed manner and the counterholder is arranged thereon preferably in an axially movable fashion by means of a hydraulic piston. The pressure punch is preferably arranged as a cylindrical pressure sleeve. The distance of the pressure surface which is adjusted to the length of the preform to the face side of the mandrel can be adjusted by means of spacer rings for example.

For ejecting the workpiece the mandrel is held in a rotatable manner in the production of a helical gearing.

With respect to the method employed, the production of the workpiece with internal toothing occurs in such a way that a cup-like preform, comprising a floor and substantially cylindrical side walls, is reduced in its outside diameter by means of a mandrel having the external profile according to the internal toothing to be produced, so that the material of the cylinder wall region flows into the external profile of the mandrel. According to the invention, the reduction of the outside diameter occurs by ironing by means of a drawing ring. During the ironing the axial compressive stresses are applied onto the cylindrical side walls of the preform, so that the flow of material into the profile of the mandrel is promoted. The axial compressive stresses are preferably applied by a pressure punch acting upon the face side of the cylinder wall. A counterholder acts simultaneously on the lower side of the floor in order to avoid deformations in the floor region and to apply a counterholding force. The counterholding force of the counterholder and the force of the pressure punch should be controllable with respect to each other in such a way that during the entire ironing process a flow of material is ensured in the radial direction to completely fill the shape of the mandrel.

During the ironing, the pressure punch carries out an axial stroke movement according to the ironing length of the preform in the direction of the advancing movement of the drawing ring which is controlled depending on its pressure force.

The invention allows for the first time producing internally geared workpieces in high quality on a conventional press in an energy-saving manner. The productivity can be increased by four to six times in comparison with flow-turning.

BRIEF DESCRIPTION OF THE DRAWINGS

The invention is now explained in closer detail by reference to an embodiment and the pertinent drawings, wherein.

DETAILED DESCRIPTION OF THE INVENTION

Figure 1:
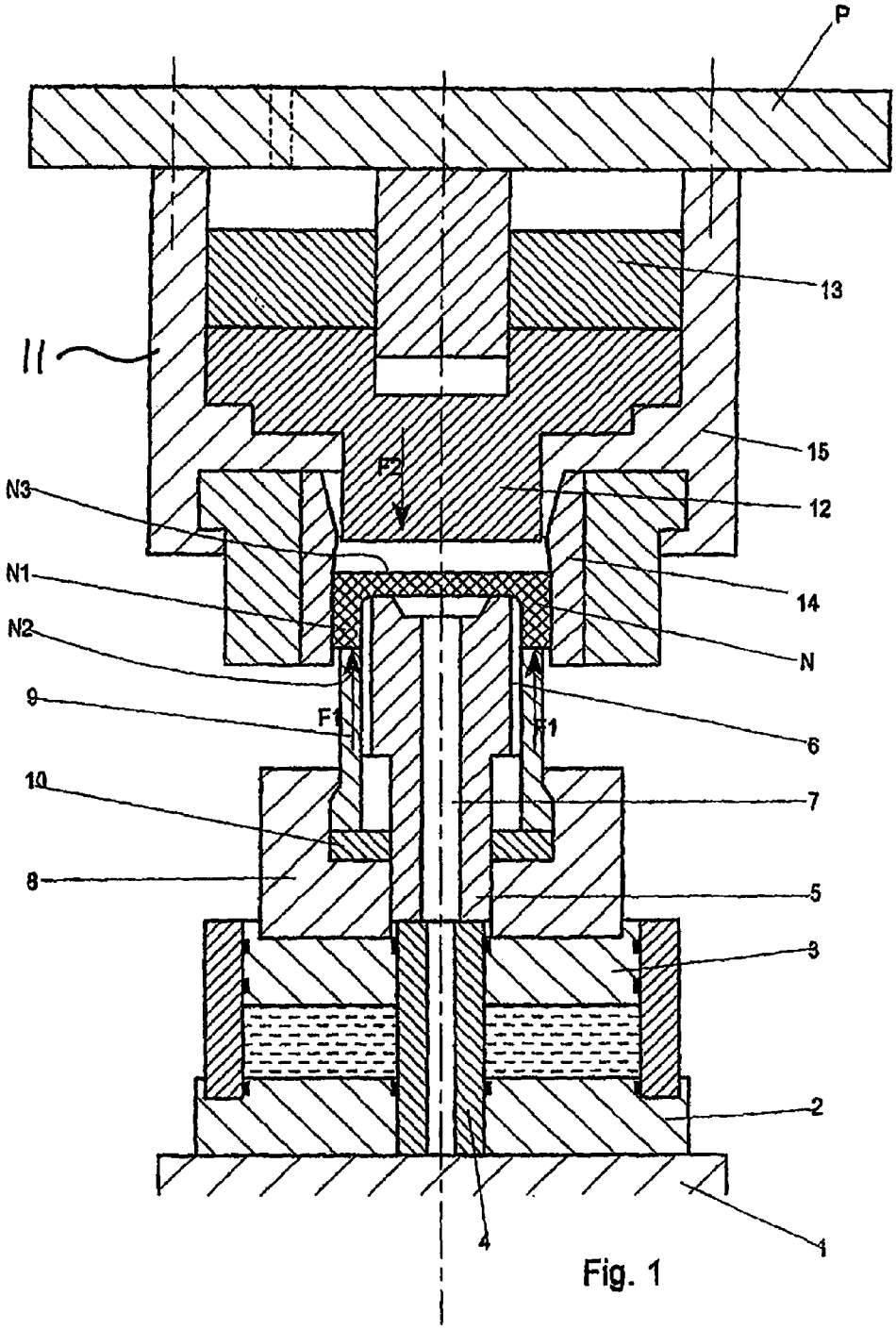
FIG. 1 shows an apparatus with an inserted preform before the ironing.
Figure 2:
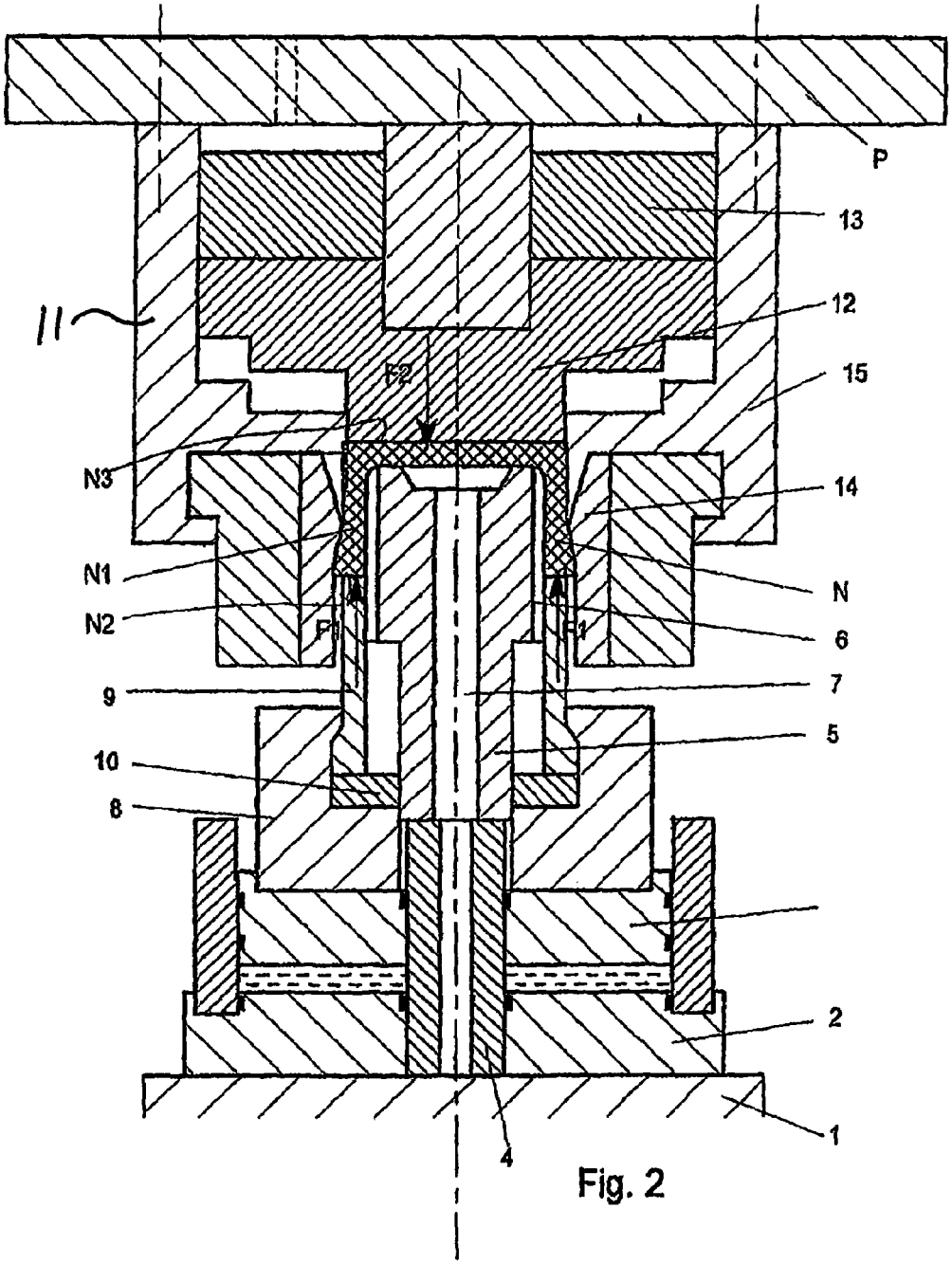
FIG. 2 shows an apparatus during the ironing.

FIGS. 1 and 2 show the principal configuration of the apparatus as integrated in a press. The lower part 2 of the tool is arranged on the bedplate 1, which lower part comprises a first hydraulic piston 3. The mandrel 5 is fastened in an axially fixed manner via a stamp 4 to the lower part 2 of the tool, which mandrel has an external profile 6. An ejector 7 extends in the middle of the stamp 4 and the mandrel 5. The pressure punch 9 which is arranged as a pressure sleeve is held in an axially movable way on the hydraulic piston 3 via an adapter 8. The axial position of the pressure punch 9 can be changed via spacers 10 which can be attached between the adapter 8 and the pressure punch 9. The upper part 11 of the tool is arranged on the press ram P and comprises a counterholder 12 which is axially adjustable via a second hydraulic piston 13. The drawing ring 14 is fastened in a fixed manner on the press ram via an adapter 15.

According to FIG. 1 the cup-like preform N was placed over mandrel 5 with the cylindrical edge N1 facing downwardly, so that the face surface N2 faces in the direction towards the press stamp 9 and the lower side of floor N3 faces in the direction towards the counterholder 12. According to the method, the hydraulic piston 13 moves the counterholder 12 in the direction towards the lower part of the tool until the counterholder 12 rests on the lower side of floor N3.

The drawing ring 14 which is arranged in a fixed fashion on the press ram P moves in the pre-stroke with the press ram P in the direction towards the bedplate 1. At the same time, the first hydraulic piston 3 is pressurized and presses the press stamp 9 with the force F1 against the face surface N2 of the preform N (FIG. 2). At the same time, the counterholder 12 acts a counterholding force F2 on the floor of the cup. During the ironing the pressure punch 9 performs a movement in the direction of the pre-stroke of the drawing ring 14 according to the drawing of the preform N, with the pressure acting upon the wall N2 being maintained by the forces F1 and F2. As a result of the compressive stresses produced in the workpiece wall N2, the flow of material is promoted, so that the material flows reliably into the profile 6 of the mandrel 5. An outstanding quality of the internal toothing is thus achieved. After the completion of the ironing, the upper part 11 of the tool moves upwardly and the workpiece is removed form the mandrel 5 by means of the ejector 7, with the same being held in a rotatable fashion in the case of a helical gearing.

Figure 3:
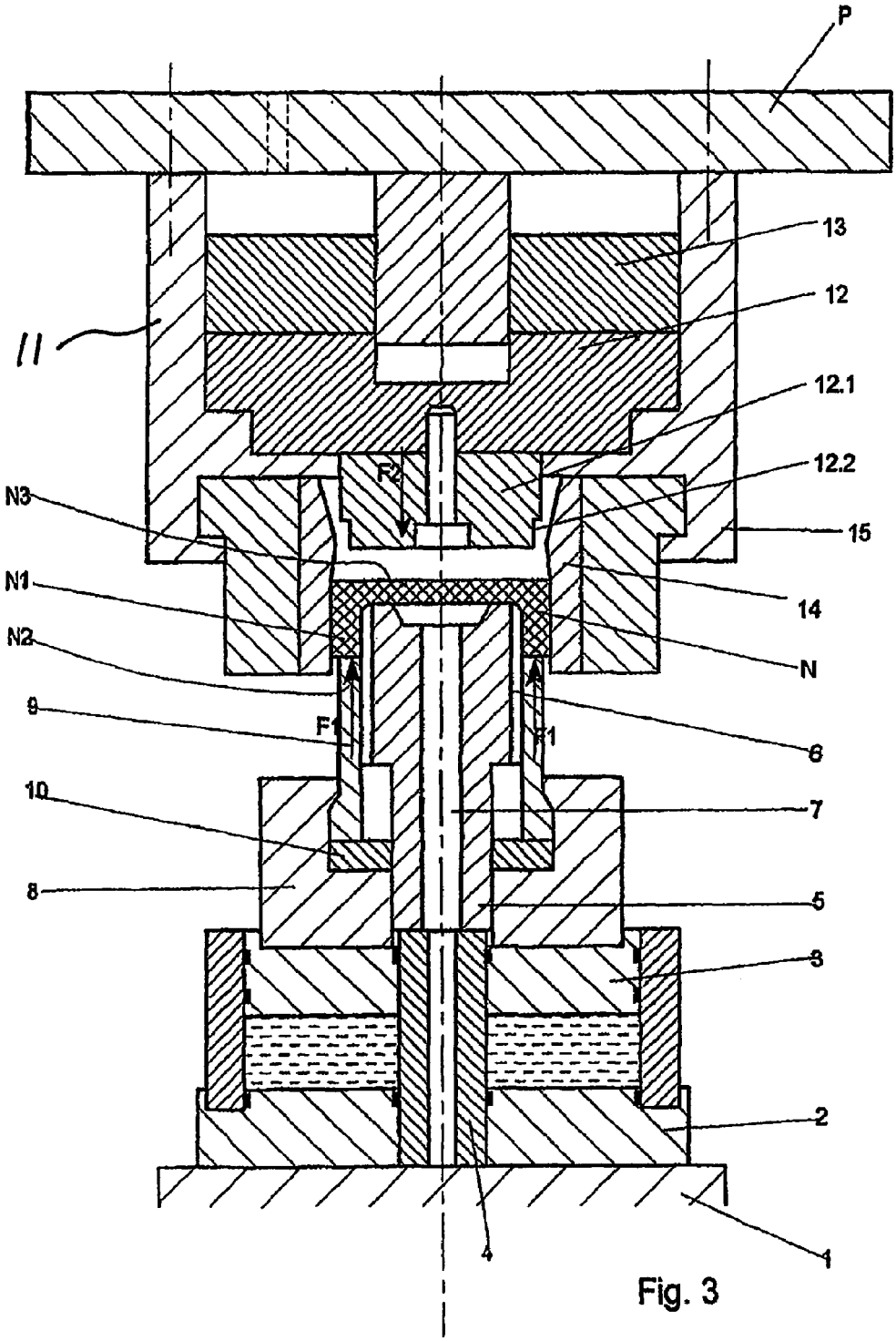
FIG. 3 shows an apparatus with an inserted preform and material overflow in the counterholder before the ironing.
Figure 4:
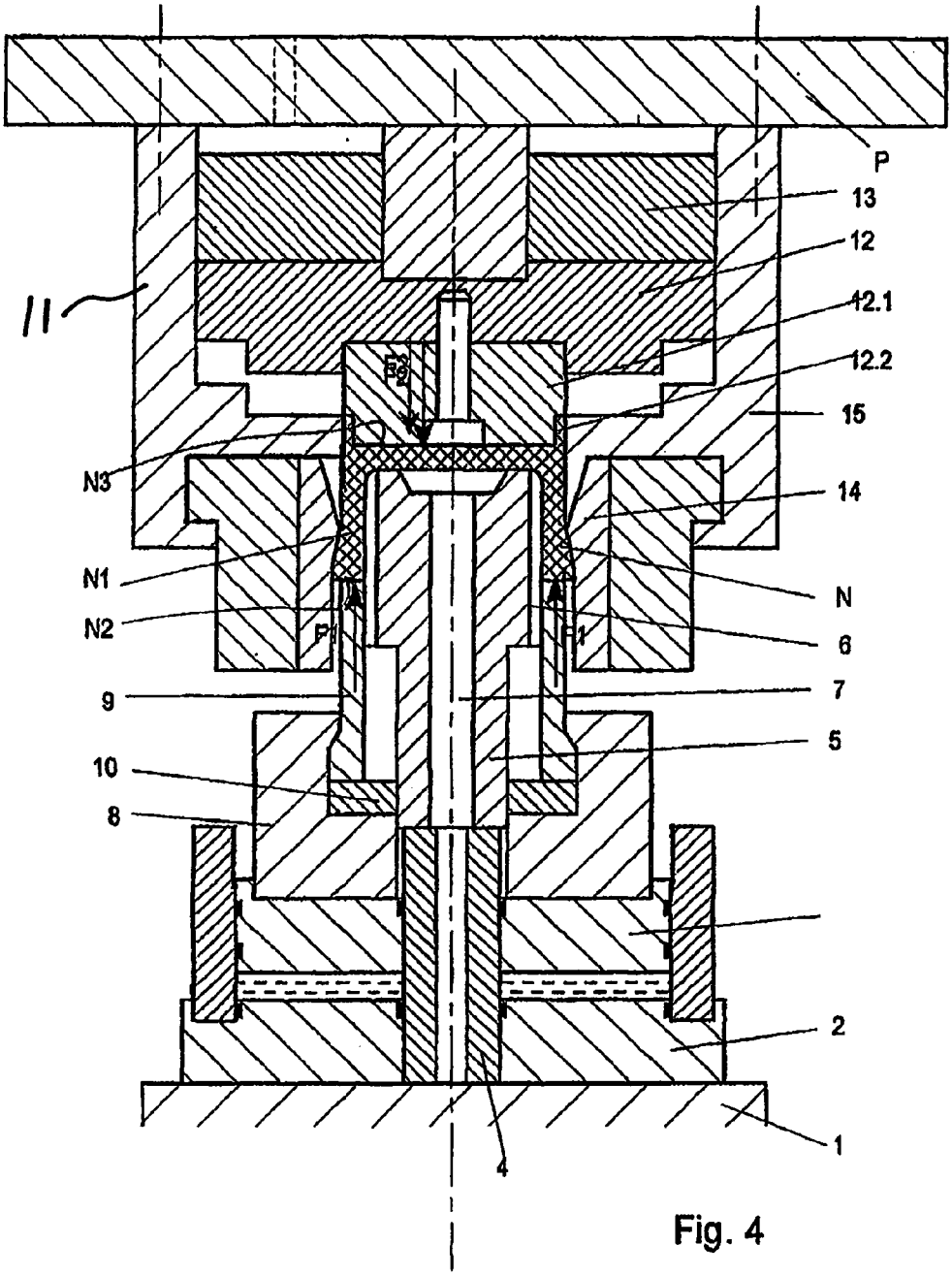
FIG. 4 shows an apparatus according to FIG. 3 during the ironing.

In order to allow excessive material to flow off and to avoid overloading the tool it is possible according to FIGS. 3 and 4 to provide a material overflow 12.2 in the counterholder 12. The counterholder 12 comprises a thrust member 12.1 in the direction towards the workpiece N, which member is also reduced in its diameter in the direction towards the workpiece N, thus producing a gap between the thrust member 12.1 and adapter 15 into which the excessive material can flow and which is thus used as a material overflow 12.2.

Figure 5:
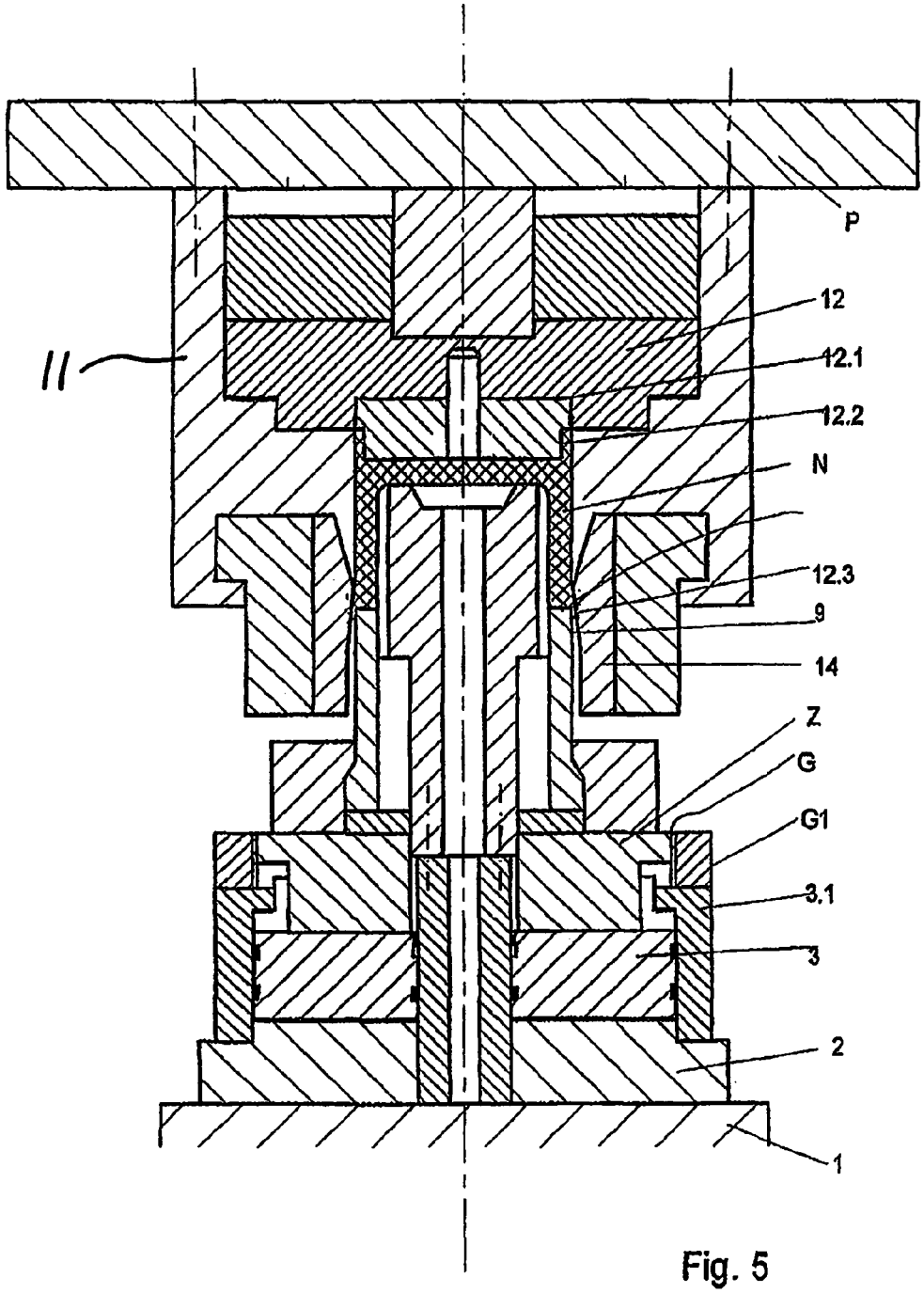
FIG. 5 shows an apparatus after ending the ironing with an additional calibrating pressure and additional material overflow at the end of the cylindrical edge of the workpiece.

According to FIG. 5 it is also possible, in addition to the material overflow 12.2 as provided for in FIGS. 3 and 4, to arrange a further material overflow 12.3 at the end of the cylindrical wall. The gap between the outside diameter of the pressure punch 9 and the inner diameter of the drawing ring 14 can be used for this purpose.

It is further advantageous when at the end of the forming process an increased axial pressure for calibration is exerted in order to achieve a better filling and a higher excessive material can flow off as described above. After cylinder 3.1 is situated in its lowermost position. The increased pressure can now be applied in such a way for example that the pressure punch 9 via an intermediate piece Z which comprises a thread G on its outside diameter and is connected above with a ring follower G1 which on its part rest on the cylinder 3.1 and thus on the bedplate 1 via the lower part 2 of the tool.

The invention claimed is:

1. An apparatus for producing a workpiece with internal teeth from a cup-shaped preform having a substantially cylindrical side wall and a cup base at one axial end of said sidewall, said apparatus comprising:

a press bed plate;

a mandrel axially fixedly mounted on said bed plate, said mandrel having an external profile corresponding to the internal teeth to be produced on the workpiece;

an annular punch surrounding said mandrel, said punch being moveable axially relative to said mandrel so that the punch can engage an axial end face of a preform disposed on said mandrel with an inside surface of said cup base contacting said mandrel;

a press ram movable to advance toward said base plate;

a forming tool in the form of a drawing ring axially fixedly mounted on said press ram, said drawing ring surrounding said punch and having an area of reduced inner diameter for reducing the diameter of the cylindrical sidewall of the preform on the mandrel during an advancing movement of the press ram and drawing ring and causing material of the cylindrical side wall to flow into the external profile of the mandrel; and a counter holder mounted on said press ram; said counter holder being moveable axially relative to said drawing ring so that the counter holder can engage an outside surface of said cup base of the preform on the mandrel; wherein said annular punch and said counter holder exert opposing axial forces on the preform to produce compressive stress in the cylindrical sidewall of the preform during the advancing movement of the press ram and drawing ring.

2. An apparatus according to claim 1, further comprising an ejector in said mandrel for ejecting an internally toothed workpiece from the mandrel when the apparatus is opened.

3. An apparatus according to claim 1, wherein said counter holder comprises a circular pressure surface facing the outside surface of the cup base of the preform, said circular pressure surface acting upon substantially the entire base of the preform.

4. An apparatus according to claim 1, wherein said counter member comprises an annular pressure surface which is aligned with the cylindrical wall of the preform, said annular pressure surface acting upon a radially outer annular region of the base of the preform.

5. An apparatus according to claim 1, wherein said pressure punch is moveable axially by a hydraulic piston.

6. An apparatus according to claim 1, wherein said counter holder is moveable axially by a hydraulic piston.

7. An apparatus according to claim 1, wherein a gap is provided between the counter holder and a tool part on the press ram into which material overflow from the preform can flow.

8. An apparatus according to claim 1, wherein a gap is provided between the annular punch and the drawing ring into which material overflow from the preform can flow.

9. An apparatus according to claim 1, wherein said mandrel is rotatably mounted for ejecting the workpiece.

10. An apparatus according to claim 1, wherein said drawing ring comprises an inner cylindrical section having an inner diameter just larger than the outer diameter of the preform, a first frustoconical section which converges from said inner cylindrical section to said area of reduced inner diameter, and a second frustroconical section on the other side of the reduced diameter area which diverges from said reduced diameter area to a larger diameter than said reduced diameter area.

11. A method of producing a workpiece with internal teeth, said method comprising:

providing a cup-shaped preform having a substantially cylindrical sidewall and a cup base at one axial end of the sidewall;

disposing the preform in a forming tool with the inside surface of the cup base contacting a mandrel fixedly mounted on a press bed plate, said mandrel having an external profile corresponding to the internal teeth to be produced on the workpiece;

contacting an end face at a second axial end of the preform with an annular punch surrounding said mandrel; said annular punch being moveable axially relative to said mandrel and press bed plate;

contacting the outside surface of the cup base with a counter holder mounted on a press ram moveable to advance toward said bed plate; said counter holder being moveable axially relative to said press ram;

providing a forming tool in the form of a drawing ring fixedly mounted on the press ram, said drawing ring surrounding said punch and having an area of reduced inner diameter smaller than the outer diameter of the cylindrical sidewall of the preform, and advancing the press ram to move the reduced diameter area of the drawing ring along the exterior of the cylindrical sidewall of the preform to reduce the diameter of the cylindrical sidewall and cause material of the cylindrical side wall to flow into the external profile of the mandrel;

said annular punch and said counter holder exerting opposing axial forces on the preform to produce compressive stress in the cylindrical sidewall of the preform during the advancing movement of the press ram and drawing ring.

12. A method according to claim 11, wherein said preform is elongated during the advancing movement of the drawing ring, and wherein the annular punch retracts toward the bed plate an amount equal to the elongation of the preform.

13. A method according to claim 11, wherein said drawing ring comprises an inner cylindrical section having an inner diameter just larger than the outer diameter of the preform, a first frustoconical section which converges from said inner cylindrical section to said area of reduced inner diameter, and a second frustroconical section on the other side of the reduced diameter area which diverges from said reduced diameter area to a larger diameter than said reduced diameter area.

14. A method according to claim 11, wherein upon completion of the advancing movement of the press ram, an increased axial force is exerted on the formed workpiece for calibrating the workpiece.

15. A method according to claim 11, wherein during production of the workpiece, excess material from the workpiece flows into a material overflow gap.

16. A method according to claim 15, wherein said material overflow gap is between the counter holder and a tool part mounted on the press ram.

17. A method according to claim 15, wherein said material overflow gap is between the annular punch and the drawing ring.

18. A method according to claim 11, further comprising retracting the press ram to open the tool, and rotating said mandrel to eject the formed workpiece.

19. A method according to claim 11, wherein said pressure punch is moved axially by a hydraulic piston.

20. A method according to claim 11, wherein said counter holder is moved axially by a hydraulic piston.

* * * * *